United States Patent [19]

Hsu

[11] Patent Number: 4,628,979

[45] Date of Patent: Dec. 16, 1986

[54] WINDOW BLIND

[76] Inventor: Pei-Shun Hsu, No. 373, Sec. 4, Yen Hai Road, Fu-Nan Tsun, Fu-Hsin Hsian, Chang-Hua Hsieng, Taiwan

[21] Appl. No.: 693,214

[22] Filed: Jan. 18, 1985

[51] Int. Cl.[4] ..... E06B 9/26

[52] U.S. Cl. ..... 160/115; 160/176 R

[58] Field of Search ..... 160/115, 84 R, 166 R, 160/174, 176 R, 176 B, 178 R, 177, 32, 34

[56] References Cited

U.S. PATENT DOCUMENTS

| | | | |
|---|---|---|---|
| 2,117,953 | 5/1938 | Grau | 160/114 |
| 2,920,694 | 1/1960 | Falotico | 160/114 |
| 4,141,402 | 2/1979 | Marotto | 160/176 R |
| 4,487,243 | 12/1954 | Debs | 160/176 R |

*Primary Examiner*—Robert W. Gibson, Jr.

*Attorney, Agent, or Firm*—Browdy and Neimark

[57] ABSTRACT

A window blind which includes a plurality of horizontal slats that can be regulated to simulate a pleated window blind.

2 Claims, 7 Drawing Figures

WINDOW BLIND

BACKGROUND OF THE INVENTION

This invention relates to a window blind, particularly to a window blind having a plurality of horizonal slats that can be regulated to have an appearance of a pleated shade.

A pleated window blind typically includes a pleated shade made of cloth or the like which can be closed and opend by using two strings that raise and lower the shade. The pleated window blind offers a good appearance but it can not regulate the entering light as desired.

SUMMARY OF THE INVENTION

An object of the invention is to provide a window blind having a plurality of slats that can be regulated to give an appearance of a pleated shade.

This and other objects can be achieved in accordance with the invention thrugh the provision of a window blind which includes a long-shaped support, a shade constituted of a plurality horizontal slats suspended from the long-shaped support, and a mechanism for regulating the slats, wherein the mechanism comprises at least one first roller and at least one second roller mounted for rotation about two parallel horizontal axes in the support, two gear members coaxially mounted with the first roller and second roller respectively and meshed with one another, means for driving one of the gears, at least one first regulating string attached to said first roller and extending downward on front and rear sides of the shade and having first cross-pieces attached thereto at regular intervals for holding every other slats, and at least one second regulating string attached to the second roller and extending downward on front and rear sides of the shade and having second cross-pieces attached thereto at regular intervals and holding the slats alternatingly with the first cross-pieces.

The present exemplary preferred embodiment will be described with reference to the accompanying drawings.

DETAILED DESCRIPTION OF THE PREFERRED EMBODIMENT

Figures 1, 2:
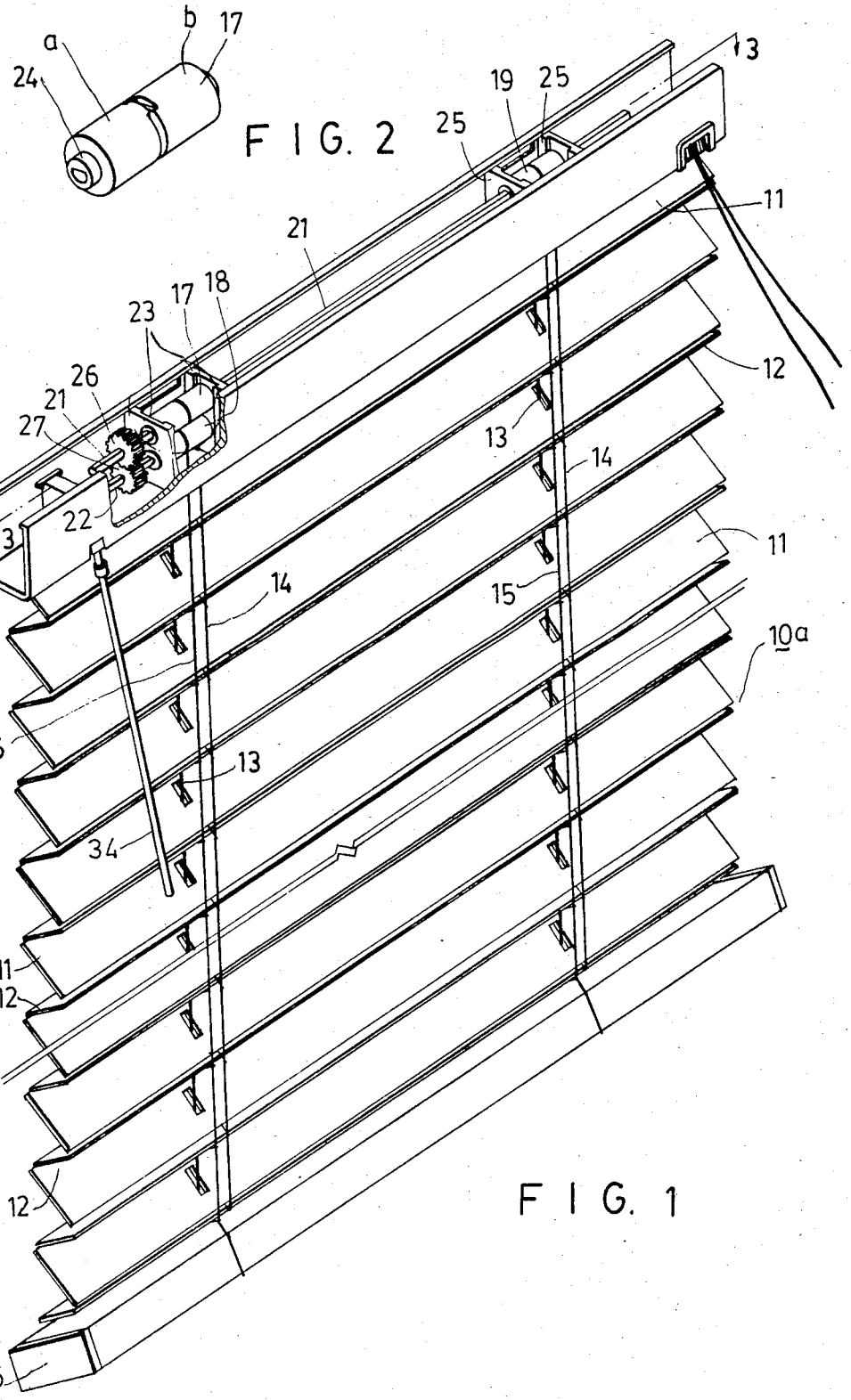
FIG. 1 is a perspective view of a window blind embodying the present invention.
FIG. 2 is an enlarged view of the roller.
Figure 3:
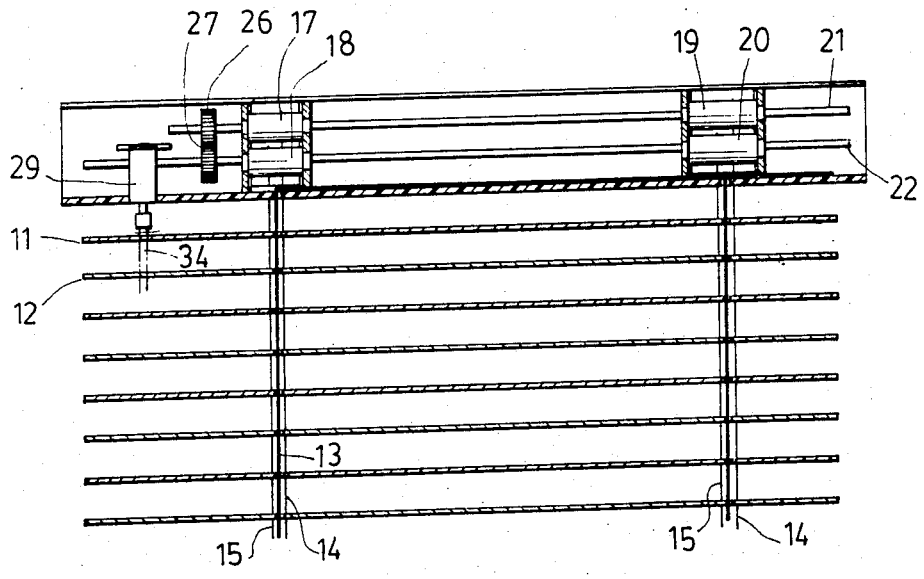
FIG. 3 is a sectioned view of the window blind taken along the plane 3—3 of FIG. 1.

Referring to FIGS. 1 and 3, there is shown a window blind which includes a long-shaped support 10 from which is suspended a shade 10*a* made of a plurality of alternating horizontal slats 11 and horizontal slats 12 by means of threading strings 13 and regulating strings 14 and 15. At the bottom end of the slats 11 and 12 is provided a bottom bar 16. The support 10 has a U-shaped cross-section and receive a mechanism for regulating the slats 11 and 12 to set them at certain inclined angles.

The mechanism includes four rollers 17, 18, 19 and 20 and two shafts 21 and 22 of semicircular cross-sections for mounting the rollers 17, 18, 19 and 20. As shown in FIG. 2, each of rollers has a hub 24 which is provided with a bore of semicircular cross-section for being sleeved onto the shafts 21 and 22, and is constituted of two tubular parts a and b separable for clamping a regulating string 14 or 15. The two ends of the hubs 24 of rollers 17 and 18 are journalled into seat plates 23 and the ends of the hubs 24 of rollers 19 and 20 are journalled in two seat plates 25. The shafts 21 and 22 are inserted in the hubs 24 of the rollers and are respectively provided with two gears 26 and 27 which are put into mesh with one another.

Two strings 14 are respectively attached to the rollers 17 and 19 by being clamped between their separable tubular parts which are better shown in FIG. 2, and are extended downward on rear side and front side of the shade, passing through apertures (not shown) provided in the bottom side of the support 10. The strings 14 are further provided with cross-pieces 14*a* attached thereto at regular intervals for regulating slats 11.

Two strings 15 are respectively attached to the rollers 18 and 20 by being clamped between their separable tubular parts which are better shown in FIG. 2, and are extended downward on the rear side and the front side of the shade, passing through apertures (not shown) provided in the bottom side of the support 10. The strings 15 are further provided with cross-pieces 15*a* attached thereto at regular intervals for regulating slats 12.

Figure 4:
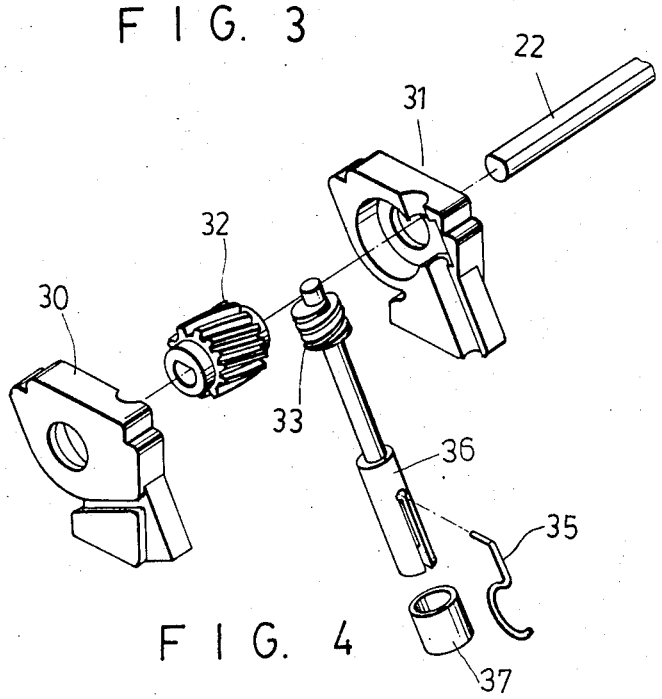
FIG. 4 is an exploded view of a drive means.

There is further provided a means 29 for driving gear 27 which include a casing formed of parts 30 and 31 housing a worm wheel 32 mounted on the shaft 22 and a worm 33 which is put into mesh with the worm wheel 32. as shown in FIG. 4. The worm 33 is provided with a stem portion 36 extended outwardly of the casing and connected to a hand operated lever 34 which is provided with a hooked end (not shown). The connection is accomplished by the engagement of the hooked end with a hook 35 securely fitted in the stem portion 36 by means of a sleeve 37.

Figure 5:
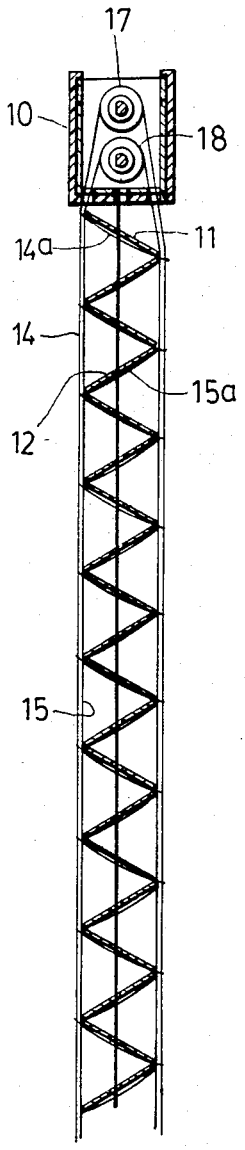
FIGS. 5 and 6 are sectioned views showing the closed positions of the window blind.
Figure 6:
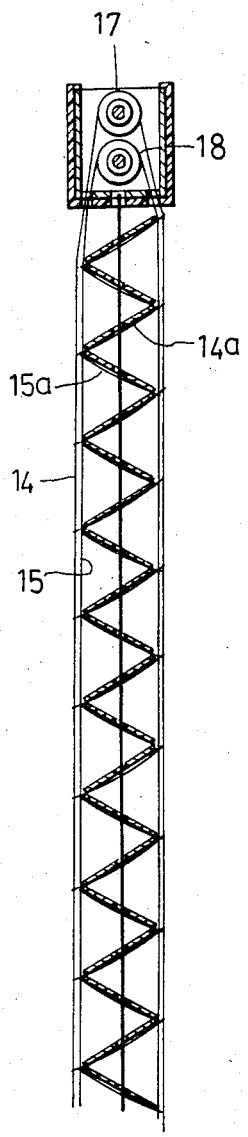

When the lever 34 is operated, the shafts 21 and 22 are rotated in opposite angular directions so that the strings 14 and 15 are moved in opposite directions on rear side and front side of the slats 11 and 12. As shown in FIG. 5, if strings 14 are moved upward on the rear side of the slats, strings 15 will moved downward on the same side, and the movements of the cross-pieces 14*a* and 15*a* will cause the slats 11 and 12 to incline upward and downward respectively to prevent the entering of light and air. The appearance of the slats 11 and 12 at this closed position resembles a pleated blind. Similarly, when the directions of the strings 14 and 15 are reversed, as shown in FIG. 6, the arrangement of the slats 11 and 12 may also have an apparance of a pleated blind.

Figure 7:
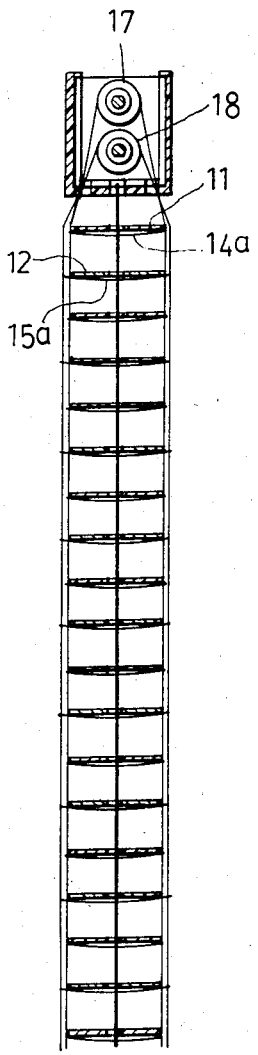
FIG. 7 is a sectioned view showing an open position of the window blind.

Referring to FIG. 7, when the cross-pieces 14*a* and 15*a* are in horizontal positions, the inclinations of the slats 11 and 12 are zero and the window blind is in its open position.

With the invention thus explained, it is apparent that various variations and modifications can be made without departing from the scope of the invention. It is therefore intended that the invention be limited as indicated in the appended claims.

I claim:

1. A window blind having a long-shaped support, a shade constituted of a plurality horizontal slats suspended from said long-shaped support, and a mechanism for regulating said slats, wherein said mechanism comprises: at least one first roller and at least one second roller mounted for rotation about two parallel horizontal axes in said support; two gear members coaxially mounted with said first roller and second roller respectively and meshed with one another; means for driving one of said gears; at least one first regulating string attached to said first roller and extending downward on front and rear sides of said shade and having first cross-pieces attached thereto at regular intervals for regulating every other said slats; and at least one second regulating string attached to said second roller and extending downward on front and rear sides of said shade and having second cross-pieces attached thereto at regular intervals and regualting said slats between said every other slats, said slats regulated by said first cross-pieces alternating with said slats regulated by said second cross-pieces.

2. A window blind as claimed in claim 1, wherein said driving means includes a worm member, a worm wheel mounted coaxially with said one gear and put into mesh with said worm member, and a lever for operating said worm member.

* * * * *